US005791210A

United States Patent [19]

Wolff et al.

[11] Patent Number: 5,791,210

[45] Date of Patent: Aug. 11, 1998

[54] SPRING-TENSIONING PLIERS

[75] Inventors: Friedrich Wolff, Bad Neuenahr; Manfred Lang, Cologne, both of Germany

[73] Assignee: Wolfcraft GmbH, Weibern, Germany

[21] Appl. No.: 948,675

[22] Filed: Oct. 10, 1997

Related U.S. Application Data

[63] Continuation of Ser. No. 610,187, Mar. 4, 1996, abandoned.

[30] Foreign Application Priority Data

Mar. 2, 1995 [WO] WIPO ..... 32326
Apr. 22, 1995 [DE] Germany ..... 295 06 836.1

[51] Int. Cl.[6] ..... B25B 7/12

[52] U.S. Cl. ..... 81/302; 81/424; 269/254 R; 269/261

[58] Field of Search ..... 81/302, 424, 418; 269/258, 261, 283, 254

[56] References Cited

U.S. PATENT DOCUMENTS

| | | | |
|---|---|---|---|
| 544,268 | 8/1895 | Unsinger et al. | 81/302 |
| 3,263,535 | 8/1966 | Zurcher | 81/302 |
| 3,779,108 | 12/1973 | Reiter | 81/424 |
| 5,022,291 | 6/1991 | McBain | 81/424 |
| 5,143,359 | 9/1992 | Bush | 81/424 X |
| 5,207,030 | 5/1993 | Herrmann | 269/254 R X |

*Primary Examiner*—James G. Smith
*Attorney, Agent, or Firm*—Antonelli, Terry, Stout & Kraus, LLP

[57] ABSTRACT

Spring-tension pliers are disclosed having two clamping arms (2, 3) mounted see-saw fashion on a pivot pin (1), the arms forming a handle (4) with their legs, the legs being pivotable toward one another against the force of a spring (5) to open a clamping mouth formed by the other ends of the legs (6), with clamping jaws (7) being associated with the free ends of the clamping legs (6). The clamping jaws (7) are pivotable around a pivot axis (8') parallel to the pivot joint axis, end sections (9) of the clamping legs are rounded concentrically with respect to jaw pivot axis (8'), and these rounded areas (11) each fit into a correspondingly rounded recess (10) of the clamping jaws.

3 Claims, 4 Drawing Sheets

SPRING-TENSIONING PLIERS

This application is a Continuation of application Ser. No. 08/610,187, filed Mar. 4, 1996 abandoned.

BACKGROUND OF THE INVENTION

The invention relates to spring-tensioning pliers.

Spring-tensioning pliers of this kind are known commercially. The spring-tensioning pliers have two tong arms articulated see-saw fashion on a joint pin. By pressing together the two arm legs that form a handle, the two clamping legs are forced apart. The spring-tensioning pliers have a spring that presses on the two clamping legs in such fashion that the clamping jaws located at the free end areas of the clamping legs are pressed against one another or clamp a workpiece between them.

If workpieces of different thicknesses are clamped with known spring-tensioning pliers, the clamping jaws are at correspondingly different angles to one another. Accordingly, the clamping jaws form different angles with one another. It is desirable however for the clamping jaws to rest flush against the workpiece. If the two clamping surfaces of the workpiece are parallel to one another, it is desirable for the clamping surfaces formed by the clamping jaws to also be parallel to one another. In general, a flush contact of the clamping jaw surface against the workpiece surface is desirable.

Hence the goal of the invention is to improve on spring-tensioning pliers according to the species in a manner advantageous for their use.

SUMMARY OF THE INVENTION

As a result of the design according to the invention, a spring-tensioning pliers is produced in which the flat portions of the clamping jaws can adapt to the surface structure of the workpiece to be clamped. The clamping jaw is articulated at the end section of the clamping jaw. A total of two opposite pivotable clamping jaws is provided. As a result of the special design of the clamping jaws, a favorable application of force is ensured through the rounded end sections of the clamping legs into the correspondingly grooved recesses in the clamping jaws. As a result of one advantageous embodiment of the invention, provision can be made such that the clamping jaws are clipped onto a pin or pin extension that lies on the axis of rotation of the clamping jaw. The clip can consist of a bushing open at its wall, so that two clip legs form a tubular bearing bush, with the slit in the wall having a width narrower than the diameter of the bearing pin of the clamping jaw. Preferably the clip fits into a U-shaped recess in the end section. The U-shaped side walls of this recess have rounded end sections that fit into grooved depressions in the clamping jaws so that the clampingjaws are pivotably mounted around the pin but the application of force can preferably be performed by the end sections. For a secure axial immobilization of the clamping jaws at their end sections, provision is made such that the clamping jaws form a bearing extension that fills the U-shaped space in the axial direction, but are made narrower in the pivoting direction so that the pivoting jaws can pivot. Groove-shaped depressions are provided on the flat tensioning surfaces of the clamping jaws.

One advantageous improvement on the invention provides that the two clamping arms are made the same, so that only one injection mold is required to produce them when the pliers are made of plastic. The spring forms two spring arms that are accommodated in the handles. The handles can have ribs for this purpose, which receive the corresponding spring arms in recesses.

BRIEF DESCRIPTION OF THE DRAWINGS

One embodiment of the invention will now be described in greater detail with reference to the attached drawings.

DETAILED DESCRIPTION OF THE PREFERRED EMBODIMENTS

Figure 1:
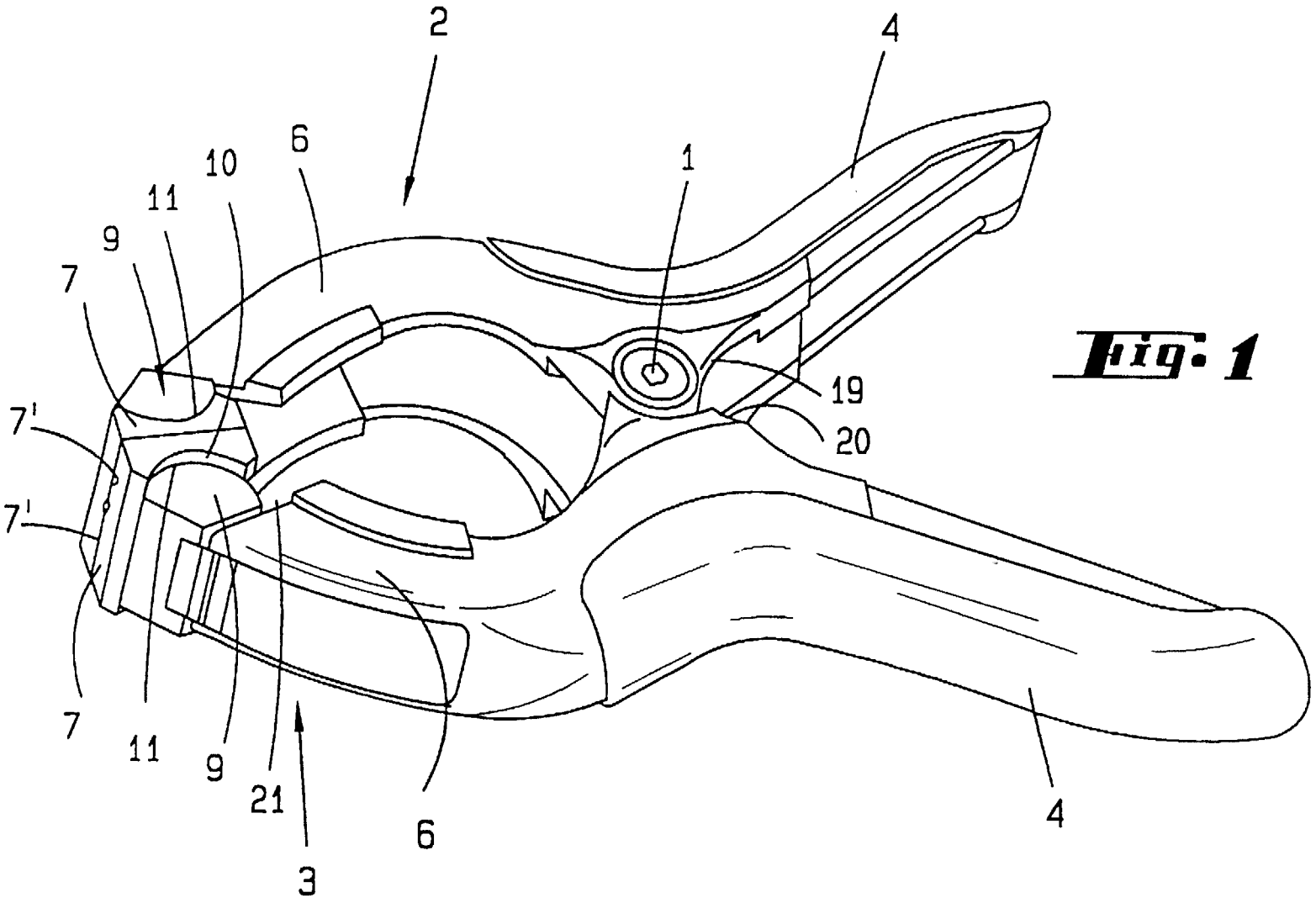
FIG. 1 is a perspective view of the spring-tensioning pliers.
Figure 2:
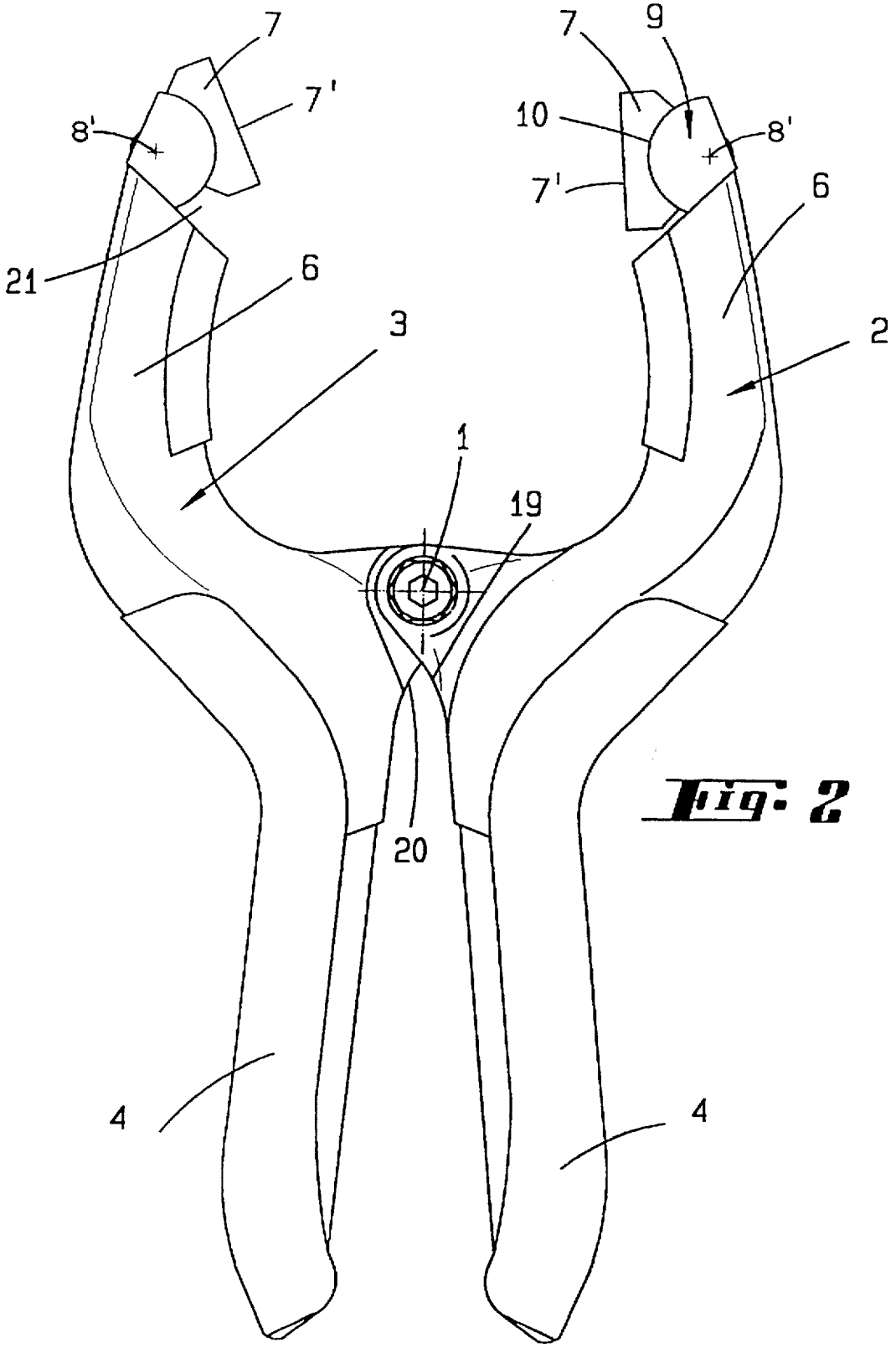
FIG. 2 is a top view in the open position.
Figure 3:
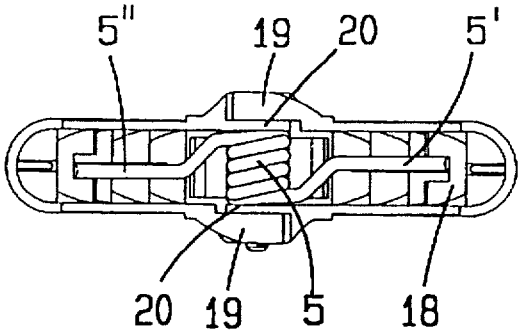
FIG. 3 is a rear view.
Figure 4:
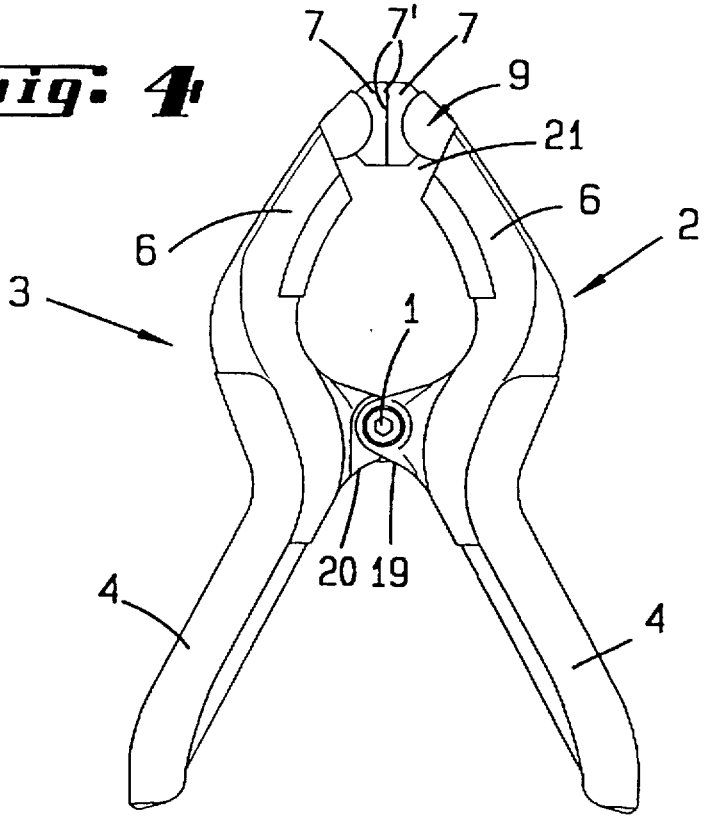
FIG. 4 is a top view in the closed position.
Figure 6:
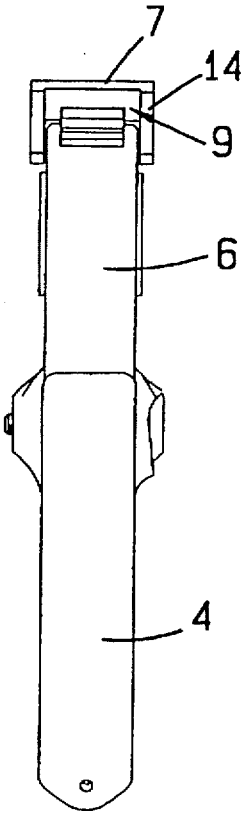
FIG. 6 is a side view.
Figure 5:
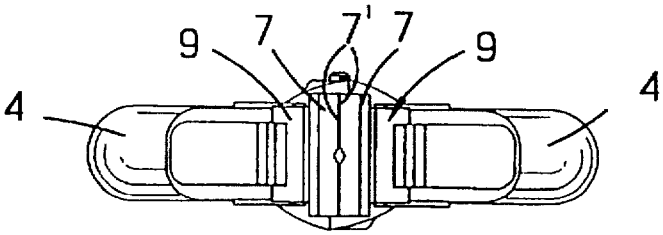
FIG. 5 is a front view.
Figure 7:
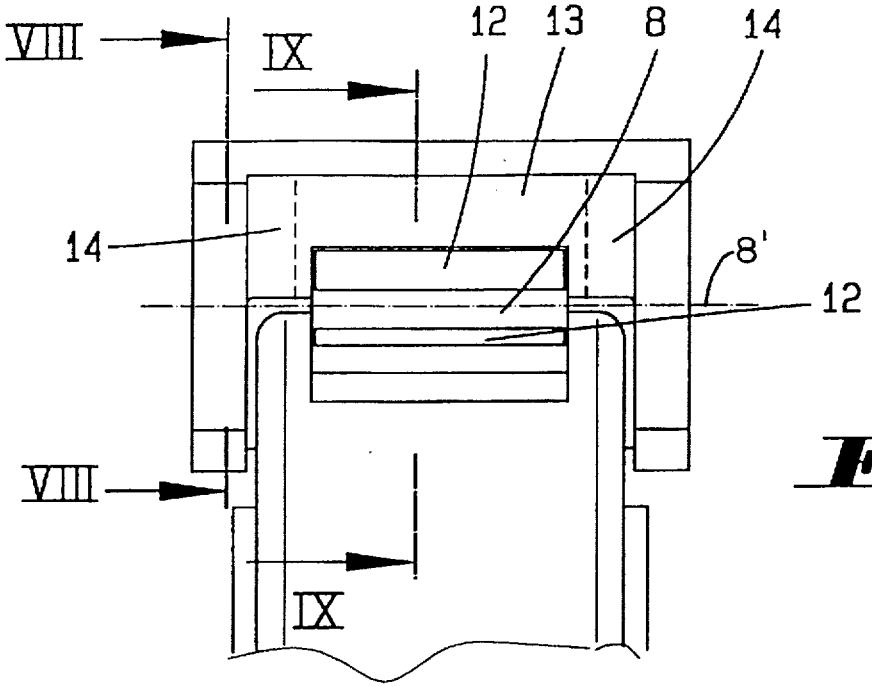
FIG. 7 is a detailed view according to FIG. 6 of the front end section of the clamping jaw.

The spring-tensioning pliers shown in the figures consist essentially of two clamping arms 2, 3 which are made identically and injection-molded from a plastic material. Clamping arms 2, 3 are connected together see-saw fashion by an articulation pin 1, so that pressing on handle 4 formed by the ends of clamping arms 2, 3, moves clamping jaws 7 apart.

A clamping jaw 7 is provided in anterior end section 9 of clamping leg 6. A total of two clampingjaws 7 opposite one another is provided, which essentially form flat clamping surfaces 7' to grip the workpiece.

Coils of a spring 5 are wound around pivot pin 1, the legs 5', 5" of said spring fitting into the portions of clamping arms 2, 3 forming handle 4.

Handle 4 consists of two opposite legs made hollow on the sides that face one another. Reinforcing ribs 18 are located in the cavity. The reinforcing ribs have recesses at their edges into which springs 5', 5" fit. The outwardly directed sides of the legs of clamping arms 2, 3 that form handle 4 are rounded, so that the handle can be gripped comfortably by the hand in use. Clamping arms 2, 3 form a constriction in the vicinity of pivot pin 1. Clamping legs 6 open toward end sections 11 of clamping legs 6 to form a clamping mouth, said mouth being surrounded by clamping legs 6.

Section 9 of clamping leg 6 forms a round edge 11. This round edge 11 fits into a depressed, round recess 10 in clamping jaw 7.

Each clamping leg 6 fonns a total of two round edges 11 parallel to one another. Round edges 11 are associated with a U-shaped side wall 14 which fonn a U-shaped recess between said edges. U-shaped recess 13 has an axle pin 8 produced by injection molding. This axle pin 8 is located at a distance from round edge 11 and fonns the center of the round part of edge 11.

Figure 8:
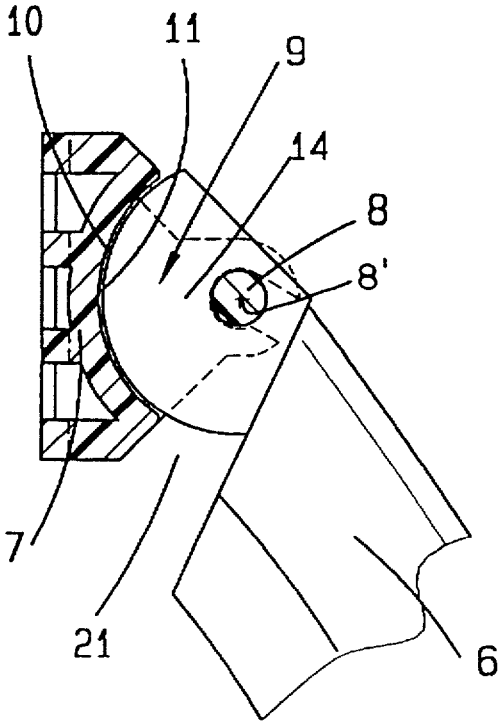
FIG. 8 is a section along line VIII—VIII in FIG. 7.
Figure 9:
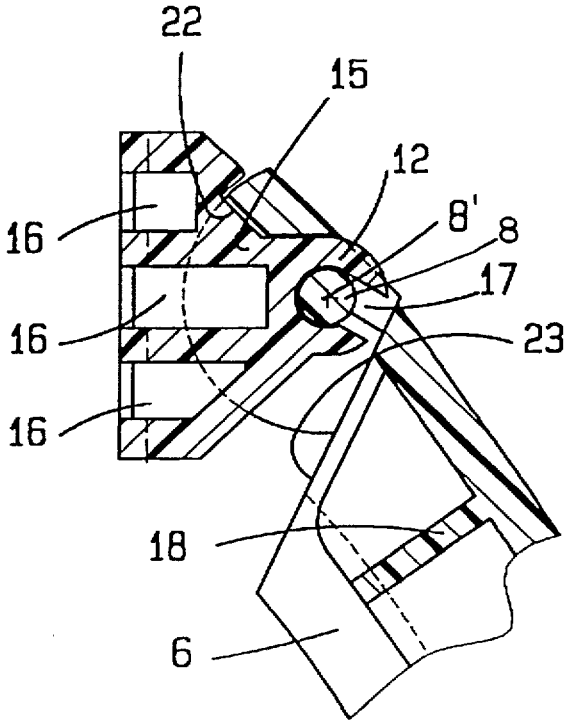
FIG. 9 is a section along line IX—IX in FIG. 7.

Axle pin 8 forms the pivot bearing lor clamping jaw 7. A bearing projection 15 forms a clip 12, said projection being received positively in the axial direction by U-shaped recess 13. The clip forms a receiving sleeve to receive axle pin 8 which is slotted endwise for placing on axle pin 8. The width of clip opening 17 is smaller than the diameter of pin 8. The pivotability of clamping jaw 7 is limited by stops 22, 23 of end section 9. Stops 22, 23 are abutted by two opposite essentially wedge-shaped sections of bearing projection 15 in each of the extreme pivot positions of clamping jaw 7. In the extreme pivot position shown in FIGS. 8 and 9, therefore, a space 21 for pivoting is provided between bearing projection 15 and stop surface 23.

Clamping surface 7' of clamping jaw 7 has groove-shaped recesses 16 which are parallel to one another and run parallel to rotational axis 1 and/or pivot axis 8'.

As a consequence of the design according to the invention, workpieces with surfaces that are parallel or nonparallel and have different thicknesses can be clamped in such fashion that the two clamping surfaces 7' rest flush against the surfaces of the workpiece. The axle pin is not under stress in the clamping position. The clamping force is initiated through round edges 11 into depressed recesses 10 in clamping jaws 7. Axle pins 8 consequently serve only to hold clamping jaws 7 and/or their pivot bearings.

All of the features disclosed are essential to the invention. The disclosure of the application also includes the contents of the disclosure of the corresponding/enclosed priority documents (copy of prior application) in full, with the additional purpose of including features from these documents in the claims of the present application.

We claim:

1. Spring-tensioning pliers comprising two clamping arms mounted see-saw fashion on a pivot pin, said two clamping arms comprising legs, first ends of which form a handle, said first ends of said legs being pivotable toward one another against the force of a spring to open a clamping mouth formed by second ends of said legs wherein each of said second ends of said legs has a U-shaped recess, having sidewalls which have convex rounded areas each of said clamping arms further comprising a jaw pivot pin provided in said U-shaped recess extending between said sidewalls and forming a jaw pivot axis parallel to said pivot pin and at a center of said convex rounded area, and a pair of clamping jaws, each of said pair of clamping jaws having a bearing extension provided between rounded recesses, said bearing extension terminating in a clip, wherein said bearing extension is provided in said U-shaped recess, said clip clipping said clamping jaw to said jaw pivot pin, said convex rounded areas of said sidewalls fitting into said rounded recesses of said clamping jaw, whereby said clamping jaw is pivotable and whereby said force of said spring initiates a clamping force through said convex rounded areas into said rounded recesses of said clamping jaws such that said jaw pivot pins are not under substantial stress in the clamping position.

2. Spring-tensioning pliers according to claim 1, characterized in that a clamping surface of clamping jaw has groove-shaped depressions.

3. Spring-tensioning pliers according to claim 1, characterized in that the two clamping arms are made the same and are injection-molded from a plastic material.

* * * * *